US009405258B2

(12) United States Patent
Fujikawa

(10) Patent No.: US 9,405,258 B2
(45) Date of Patent: Aug. 2, 2016

(54) IMAGE FORMING APPARATUS

(71) Applicant: CANON KABUSHIKI KAISHA, Tokyo (JP)

(72) Inventor: Tomoki Fujikawa, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/525,065

(22) Filed: Oct. 27, 2014

(65) Prior Publication Data

US 2015/0117924 A1 Apr. 30, 2015

(30) Foreign Application Priority Data

Oct. 30, 2013 (JP) ..... 2013-225590

(51) Int. Cl.
*G03G 15/00* (2006.01)

(52) U.S. Cl.
CPC ..... *G03G 15/6573* (2013.01); *G03G 15/6552* (2013.01)

(58) Field of Classification Search
CPC ..... G03G 15/6547
See application file for complete search history.

(56) References Cited

U.S. PATENT DOCUMENTS 4,609,283 A * 9/1986 Murata et al. ..... 399/84
5,839,048 A * 11/1998 Kato ..... B42C 1/125 270/58.09
6,076,825 A * 6/2000 Kato ..... B65H 31/00 271/207
6,421,582 B1 * 7/2002 Wada ..... B03G 15/6538 194/239
8,955,836 B2 * 2/2015 Jones ..... B65H 31/3081 271/177
2005/0035522 A1 * 2/2005 Gonzalez ..... B41J 13/106 27/1
2008/0213017 A1 * 9/2008 Morisawa ..... G03G 15/6538 399/405
2009/0081003 A1 * 3/2009 Fujihara et al. ..... 412/37
2009/0160123 A1 * 6/2009 Jones ..... 271/213
2010/0119245 A1 * 5/2010 Yahata et al. ..... 399/38
2012/0217693 A1 * 8/2012 Fukami ..... 270/58.08

FOREIGN PATENT DOCUMENTS

JP 7-10363 A 1/1995
JP 7-125909 A 5/1995
JP 11-79540 A 3/1999
JP 2004-188795 A 7/2004

* cited by examiner

*Primary Examiner* — Anthony Nguyen
(74) *Attorney, Agent, or Firm* — CANON USA, INC. IP Division

(57) ABSTRACT

An image forming apparatus includes a storage unit, a conveyance unit, an opening, and a movement unit. The storage unit stores, in an apparatus body of the image forming apparatus, a sheet having an image. The conveyance unit conveys the sheet having the image to the storage unit. The opening exposes the stored sheet to an outside of the apparatus body. The movement unit is movable to a first position where the sheet conveyed to the storage unit can be stored in the storage unit and a second position. The stored sheet is moved when the movement unit moves from the first to the second position, and is stopped in an exposed state where a part of the sheet is exposed to outside the apparatus body from the opening. The movement unit moves from the second to the first position when the sheet is in the exposed state.

20 Claims, 14 Drawing Sheets

IMAGE FORMING APPARATUS

BACKGROUND OF THE INVENTION

1. Field of the Invention

The present invention relates to an image forming apparatus including a storage unit that once stores a sheet having an image formed thereon in the apparatus.

2. Description of the Related Art

Conventionally, an image forming apparatus such as a copying machine or a printer includes a storage unit that once stores sheets each having an image formed thereon in the apparatus so that a user can receive only the his/her own sheets such that others do not see the sheets.

Japanese Patent Application Laid-Open No. 7-125909 discusses an image forming apparatus including a plurality of storage units that once stores sheets each having an image formed thereon in the apparatus in addition to a normal discharge tray provided on an upper surface of an apparatus body and commonly used by a plurality of users. The sheets stored in the storage units cannot be seen from outside the apparatus. In the image forming apparatus, the storage units are respectively assigned to users, and sheets are distributed into the different storage units for each of the users. When receiving the sheets, the user instructs the image forming apparatus to discharge the sheets so that the sheets stored in the storage unit corresponding to the user who has issued the discharge instruction are discharged out of the apparatus. Thus, the user can receive only the his/her own sheets each having the image formed thereon such that others do not see the sheets.

In Japanese Patent Application Laid-Open No. 7-125909, one storage unit is assigned to one user. Thus, if a larger number of users than the number of storage units instruct an image forming apparatus to perform printing, sheets cannot be distributed into the different storage units for each of the users. If four users instruct an image forming apparatus including three storage units to perform printing, for example, sheets of the remaining one user cannot be stored in the storage units. More specifically, only sheets of one user can be stored in one storage unit.

SUMMARY OF THE INVENTION

The present invention is directed to an image forming apparatus capable of distinguishing and storing a plurality of sheets in one storage unit.

According to an aspect of the present invention, an image forming apparatus includes a storage unit configured to store, in an apparatus body of the image forming apparatus, a sheet having an image formed on the sheet, a conveyance unit configured to convey the sheet having the image to the storage unit, an opening configured to expose the sheet stored in the storage unit to an outside of the apparatus body, and a movement unit configured to be movable to a first position where the sheet conveyed to the storage unit by the conveyance unit can be stored in the storage unit and a second position which is closer to the opening than the first position, wherein the sheet stored in the storage unit is moved when the movement unit moves from the first position to the second position, and is stopped in an exposed state where a part of the sheet is exposed to the outside of the apparatus body from the opening, and wherein the movement unit moves from the second position to the first position when the sheet is in the exposed state.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

A first exemplary embodiment of the present invention will be described in detail below with reference to the drawings.

(Configuration Diagram of Image Forming Apparatus)

Figure 1:
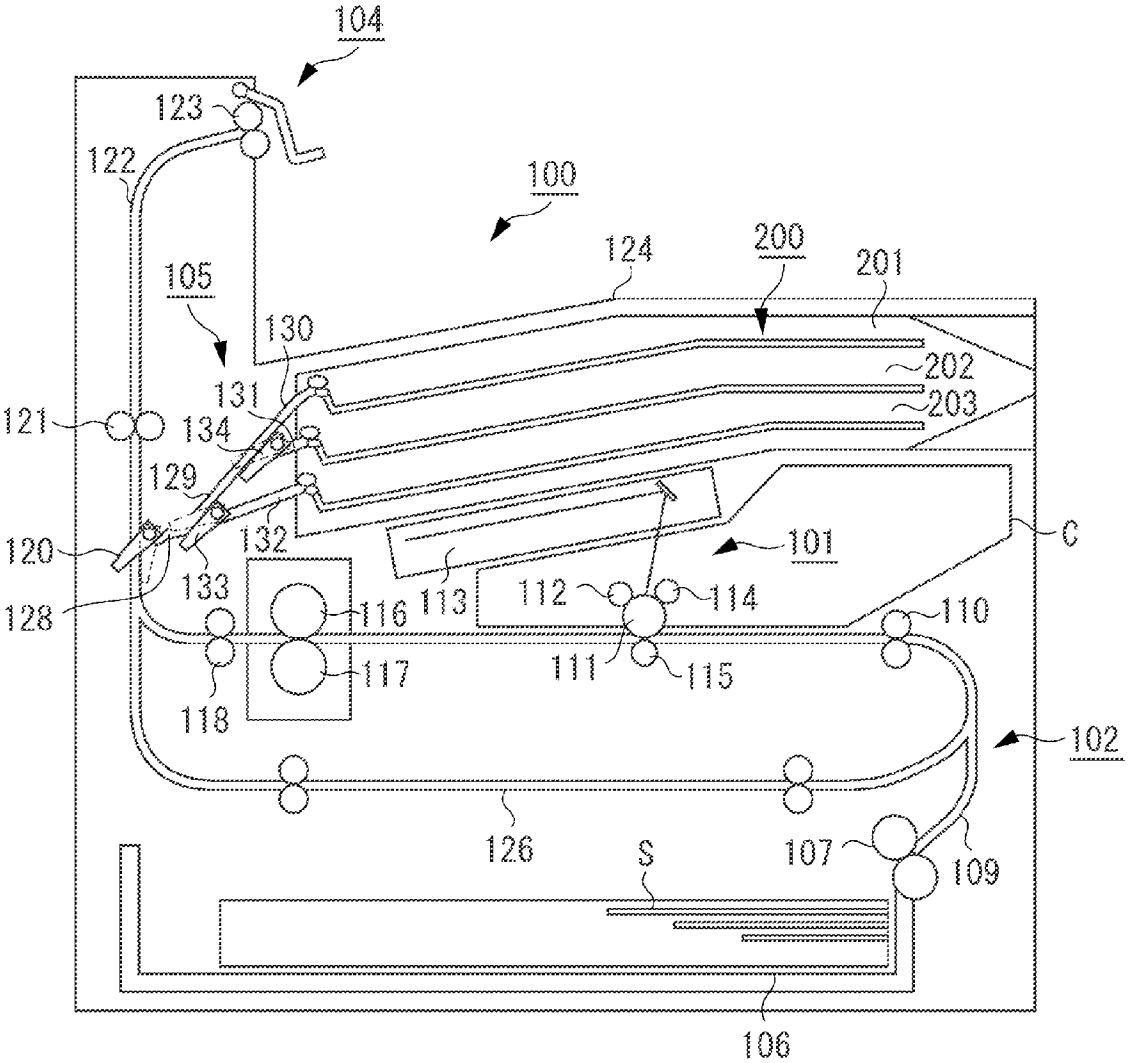
FIG. 1 illustrates a configuration of an image forming apparatus according to an exemplary embodiment of the present invention.

FIG. 1 illustrates a configuration of an image forming apparatus including a storage unit according to a first exemplary embodiment of the present invention. In the present exemplary embodiment, a laser beam printer is illustrated as the image forming apparatus.

An image forming apparatus 100 includes an image forming unit 101, a feeding unit 102 that feeds a sheet S to the image forming unit 101, and a discharge unit 104 that discharges the sheet S having an image formed thereon by the image forming unit 101. The sheet S includes paper, an overhead projector (OHP) sheet, and a cloth. A storage device 200 includes a plurality of storage units 201 to 203 that once stores the sheet S having the image formed thereon in the apparatus. The storage device 200 is provided above the image forming unit 101. The image forming apparatus 100 further includes a conveyance unit 105 that conveys the sheet S having the image formed thereon to the storage device 200.

The image forming unit 101 includes a photosensitive drum 111 that rotates in a clockwise direction (CW direction) in FIG. 1, a charging roller 112 that charges a surface of the photosensitive drum 111, and an exposure device 113 that irradiates the photosensitive drum 111 with light to form an electrostatic latent image. Further, the image forming unit 101 includes a development device 114 that attaches toner to the electrostatic latent image to form a toner image on the photosensitive drum 111, and a transfer roller 115 that transfers the toner image onto the conveyed sheet S. The image forming unit 101 further includes a fixing roller 116, a pressure roller 117 that abuts on the fixing roller 116, and a fixing/discharge roller 118. The image forming unit 101 fixes the toner image, which has been transferred onto the sheet S, to the sheet S. The image forming unit 101 forms the toner image on the sheet S using such an image forming process. In the image forming apparatus 100 according to the present exemplary embodiment, the photosensitive drum 111, the charging roller 112, the development device 114, and a toner storage unit (not illustrated) for storing toner are integrated as a cartridge C, and is detachably attached to the image forming apparatus 100. A user can replace the cartridge C when the toner runs out. The present invention is not limited to the image forming apparatus 100 of such a cartridge type, and is also applicable to an image forming apparatus 100 having a configuration in which members such as the photosensitive drum 111, the charging roller 112, and the development device 114 are fixedly installed (of such a type that the members need not be replaced).

The feeding unit 102 includes a feeding cassette 106 that stores a plurality of sheets S used for image formation in a stacked state, a feeding roller 107, a conveyance guide 109, and a registration roller 110.

The discharge unit 104 includes a first switching member 120, a conveyance roller 121, a discharge guide 122, a discharge roller 123, and a discharge tray 124. The first switching member 120 is switchable, by an actuator (not illustrated), between a position indicated by a solid line in FIG. 1 and a position indicated by a broken line. From the position indicated by a solid line, the sheet S having the image formed thereon is directed toward the storage device 200. From the position indicated by a broken line, the sheet S is directed toward the discharge tray 124. The discharge tray 124 is provided on an upper surface of the image forming apparatus 100, and can be used jointly by a plurality of users. The sheet S is discharged onto the discharge tray 124 with a surface (front surface) having the image formed thereon directed downward (face down).

The conveyance unit 105 includes a second switching member 133 and a third switching member 134 for switching a conveyance destination of the sheet S, and conveyance guides 128 to 132 that guide the sheet S to each of the storage units 201 to 203. Each of the second switching member 133 and the third switching member 134 is switchable by an actuator (not illustrated) to a position indicated by a solid line and a position indicated by a broken line in FIG. 1. When the sheet S is conveyed to the first storage unit 201, for example, the second switching member 133 and the third switching member 134 are respectively located at the positions indicated by the solid lines in FIG. 1. The sheet S is conveyed to the first storage unit 201 after passing through the conveyance guides 129 and 130 in this order from the conveyance guide 128. If the sheet S is conveyed to the second storage unit 202, only the third switching member 134 is switched to the position indicated by the broken line. In this case, the sheet S is conveyed to the second storage unit 202 after passing through the conveyance guides 128, 129, and 131 in this order. Each of the storage units 201 to 203 stores the sheet S face down, similarly to the discharge tray 124.

(Configuration Diagram of Storage Device)

Figure 2:
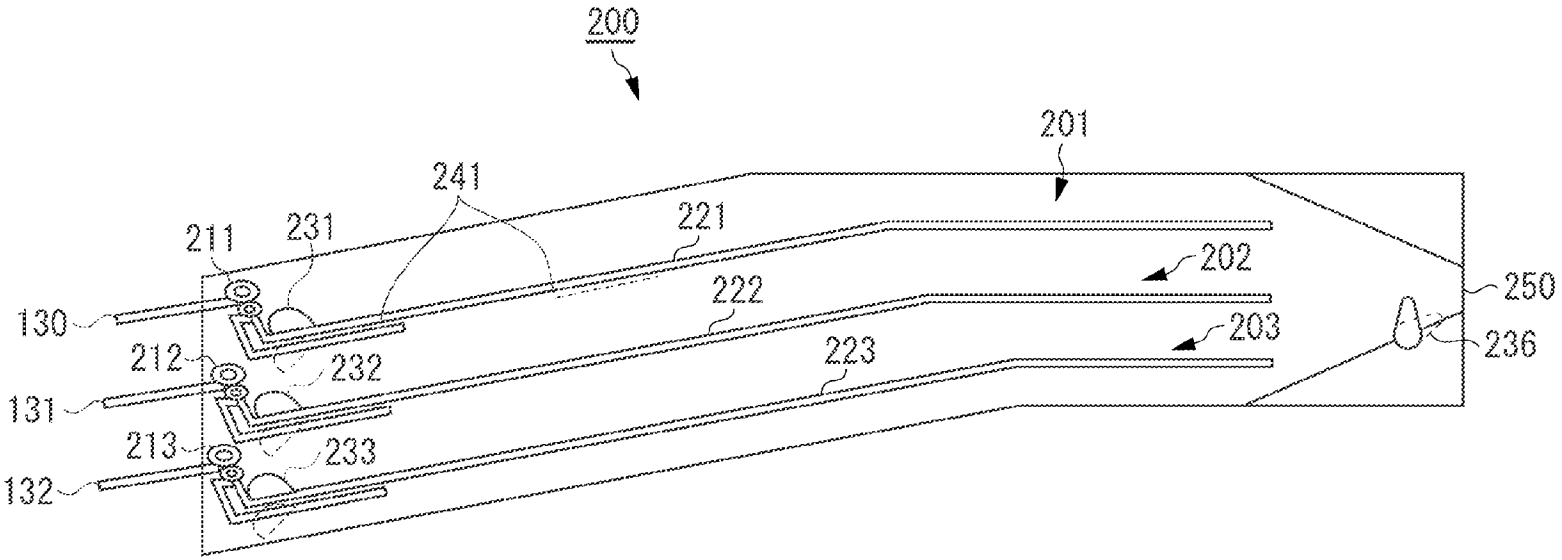
FIG. 2 illustrates a configuration of a storage device in the exemplary embodiment of the present invention.

FIG. 2 illustrates a configuration of the storage device 200. In the storage device 200 according to the present exemplary embodiment, the storage units 201 to 203 are stacked in a plurality of stages and arranged in a vertical direction. Respective configurations of the storage units are the same. The configuration of the first storage unit 201 will be described below.

The first storage unit 201 includes a conveyance roller 211 for conveying the sheet S, a stack tray 221 for stacking and once storing the sheet S, and a sheet presence/absence sensor 231 that detects whether the sheet S is stored on the stack tray 221. Further, the first storage unit 201 includes a sheet movement unit 241 that presses a trailing edge of the stored sheet S (an edge on the upstream side in a conveyance direction of the sheet S) and exposes a leading edge of the stored sheet S (an edge on the downstream side in the conveyance direction of the sheet S) to the outside of the image forming apparatus 100. The sheet movement unit 241 moves the sheet S up to a position where the user can receive the sheet S, i.e., until the leading edge of the sheet S passes through an opening 250. Thus, the sheet S can be exposed by a predetermined length to the outside of the apparatus. The predetermined length by which the sheet S is exposed to the outside of the apparatus is set to 30 mm in the present exemplary embodiment. The predetermined length 30 mm is an example, and may be set to such a length that the user can grasp the exposed sheet S and the sheet S is not greatly bent.

The stack tray 221 is bent, and is in a shape having a horizontal plane and an inclined plane, as illustrated in FIG. 2. The stack tray 221 is set to have such a length that the leading edge of the sheet S is not exposed from the opening 250 even if the sheet S of the maximum size, which can be stored in the first storage unit 201, is stacked. When the sheet S is stacked on the stack tray 221, and the sheet presence/absence sensor 231 falls to a position indicated by a broken line, the sheet presence/absence sensor 231 is turned on. When the sheet movement unit 241 moves the sheet S, and the sheet presence/absence sensor 231 returns to a position indicated by a solid line, the sheet presence/absence sensor 231 is turned off. Relative to the leading edge of the sheet S, an opening sensor 236 installed in the vicinity of the opening 250 falls to a position indicated by a broken line, the opening sensor 236 is turned on. When the sheet S, which has been exposed to the outside of the apparatus, is removed, and the opening sensor 236 returns to a position indicated by a solid line, the opening sensor 236 is turned off. The sheet movement unit 241 is positioned at a stacking position indicated by a solid line if the sheet S is sequentially conveyed to the first storage unit 201. On the other hand, the sheet movement unit 241 moves toward the opening 250 along the conveyance direction of the sheet S, and is movable to an exposure position indicated by a broken line when the stored sheet S is exposed. A location of the exposure position, i.e., a distance that the sheet movement unit 241 moves is determined depending on the length by which the sheet S is exposed and the size in the conveyance direction of the sheet S.

Figure 3:
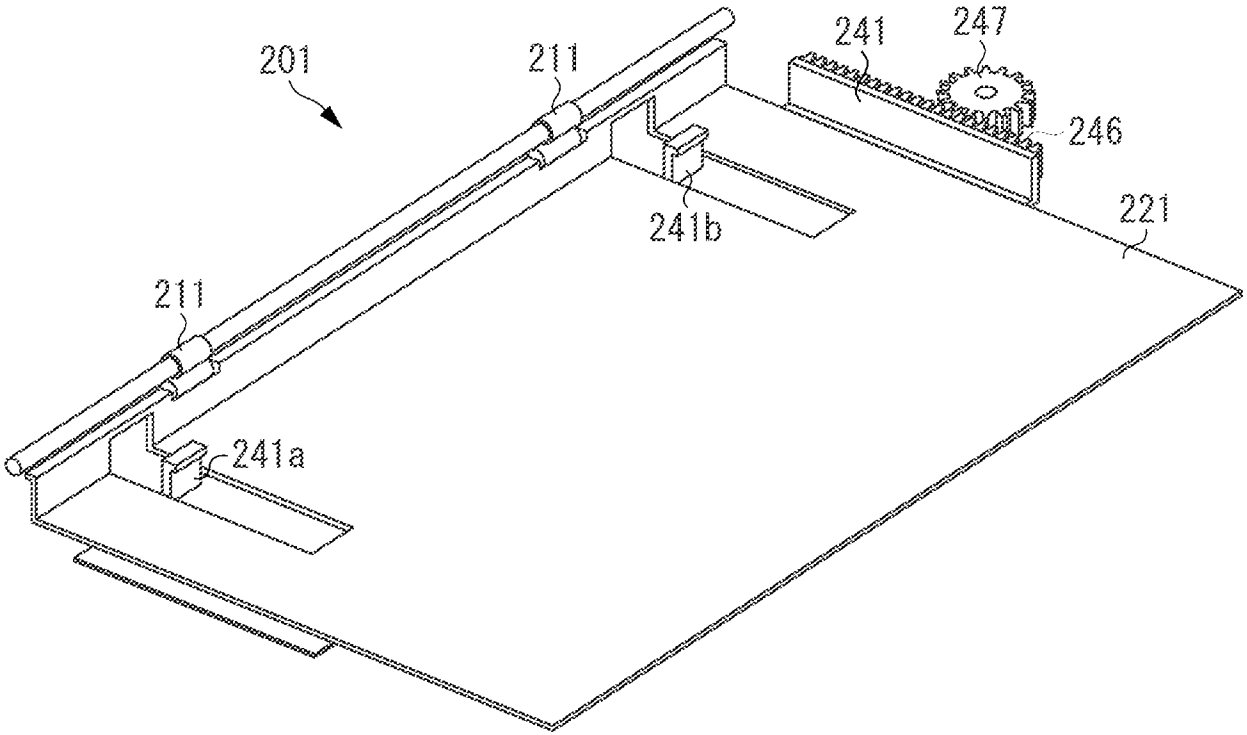
FIG. 3 is a perspective view of a storage unit in the exemplary embodiment of the present invention.

FIG. 3 is a perspective view of the storage unit 201. In FIG. 3, the sheet movement unit 241 is located at a position between the stacking position and the exposure position. The sheet movement unit 241 includes two sheet trailing edge pressing units 241*a* and 241*b* in a width direction of the sheet S. The sheet movement unit 241 integrally includes a rack 246. The rack 246 engages with a pinion 247, and the pinion 247 is connected to an actuator serving as a driving unit (not illustrated) in FIG. 3. The sheet movement unit 241 can reciprocate between the stacking position and the exposure position by driving the actuator in a forward direction or a backward direction.

(Block Diagram of Control Unit and Functional Configuration)

Figure 4:
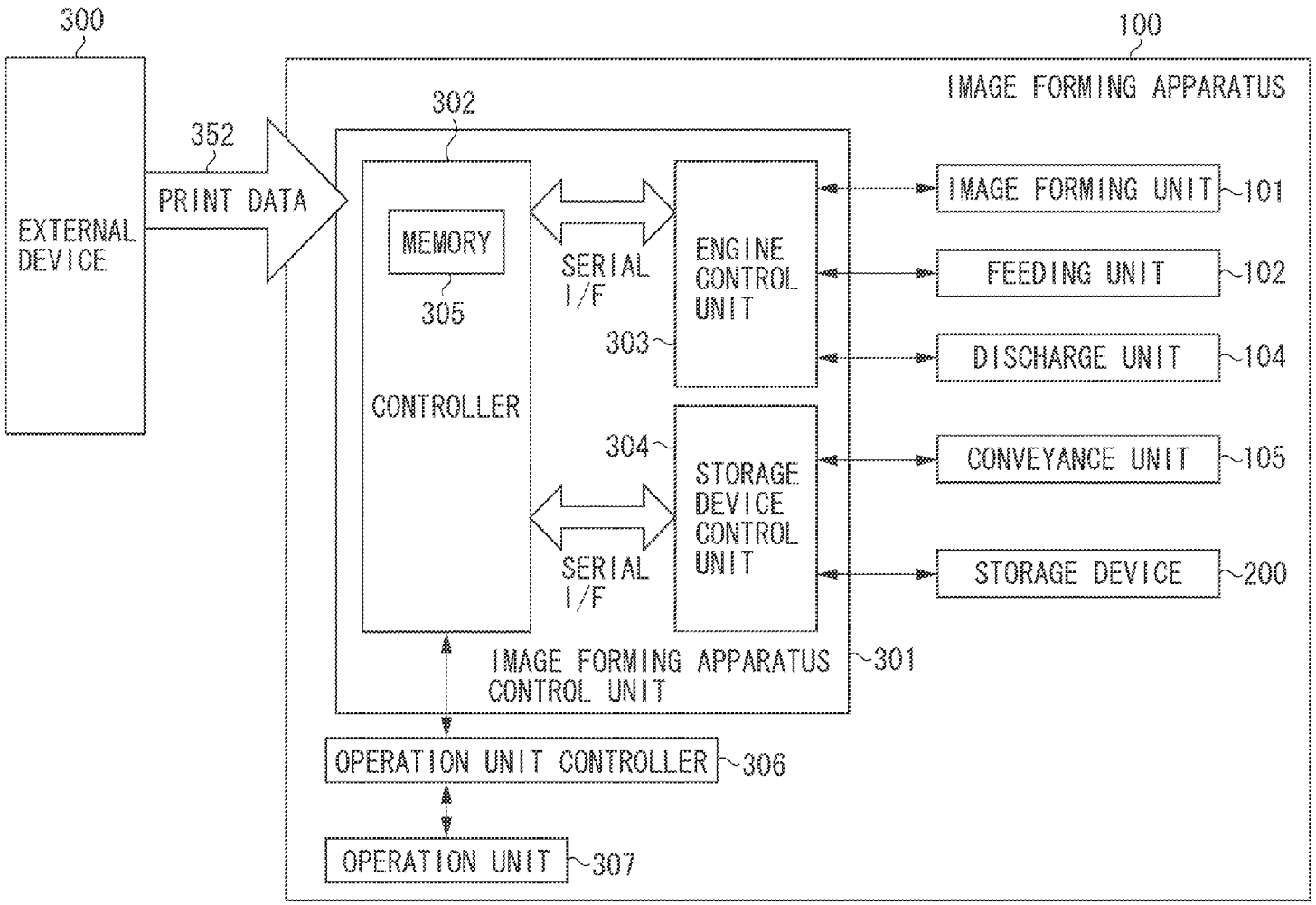
FIG. 4 is a block diagram illustrating a control unit and a functional configuration in the image forming apparatus according to the exemplary embodiment of the present invention.

FIG. 4 is a block diagram illustrating a control unit and a functional configuration in the present exemplary embodiment. The image forming apparatus 100 includes an image forming apparatus control unit 301 as its control unit. The image forming apparatus control unit 301 includes a controller 302, an engine control unit 303, and a storage device control unit 304.

The controller 302 communicates with an external device 300 such as a host computer, to receive print data 352, and stores the received print data 352 in a memory 305 (e.g., a random access memory (RAM)). The controller 302 analyzes the print data 352 stored in the memory 305, to generate a printing condition. The printing condition includes information representing the number of sheets S to be fed, a discharge destination of a sheet S having an image formed thereon, and a density of an image to be printed. The controller 302 designates through a serial I/F the printing condition generated from the print data 352 for the engine control unit 303. The engine control unit 303 controls each of mechanisms according to the printing condition received from the controller 302. More specifically, the image forming unit 101 is controlled to form the image on the sheet S, and the feeding unit 102 and the discharge unit 104 are controlled to feed and discharge the sheet S.

The controller 302 analyzes the print data 352 stored in the memory 305, and generates a storage condition and a discharge condition of each of the storage units 201 to 203. The controller 302 designates the storage condition and the discharge condition generated from the print data 352 for the storage device control unit 304 through a serial I/F. The storage condition includes information representing a storage destination of a sheet S having an image formed therein and the number of sheets S to be stored. The discharge condition includes information representing a distance by which each of sheet movement units 241 to 243 is moved to expose the sheet S from the opening 250. The storage device control unit 304 controls each of the mechanisms according to the storage condition and the discharge condition that have been received from the controller 302. More specifically, the conveyance unit 105 is controlled to convey the sheet S having the image formed thereon to each of the storage units 201 to 203, and the storage device 200 including the sheet movement unit 241 is controlled to move the sheet S stored in each of the storage units 201 to 203 to the opening 250. The operation unit controller 306 performs control to notify the controller 302 of various types of setting and a discharge instruction given by the user at an operation unit 307.

(Details of Storage Device Control Unit)

Figure 5:
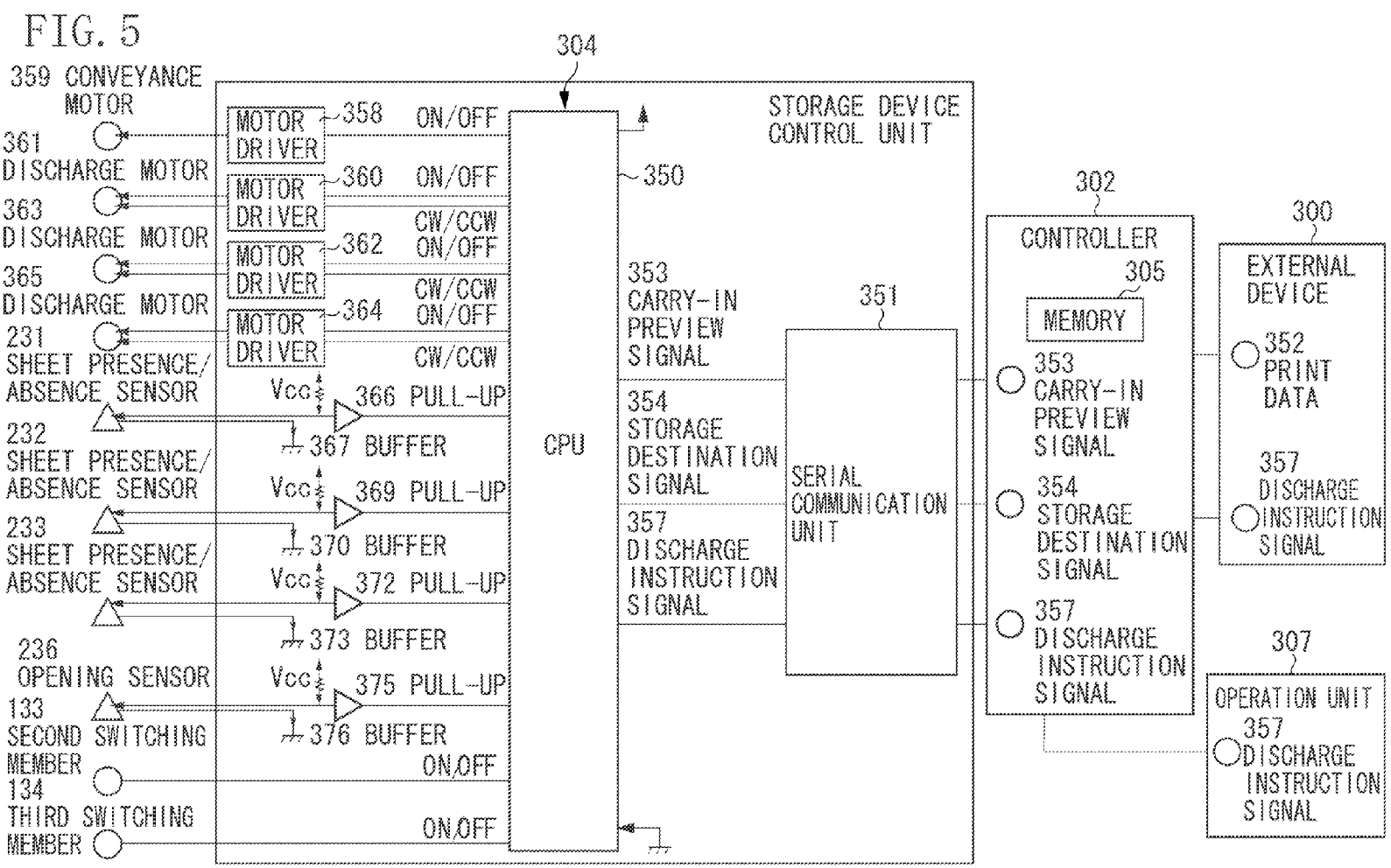
FIG. 5 is a detail view of a storage device control unit in the exemplary embodiment of the present invention.

FIG. 5 is a detail view of the storage device control unit 304 in the present exemplary embodiment. The storage device control unit 304 includes a central processing unit (CPU) 350, and communicates with the controller 302 via a serial communication unit 351. The serial communication unit 351 connects the CPU 350 and the controller 302 to each other via a plurality of signal lines. In the present exemplary embodiment, the serial communication unit 351 has three signal lines for transmitting a carry-in preview signal 353, a storage destination signal 354, and a discharge instruction signal 357, described below.

Control performed at a time when the storage device 200 stores the sheet S will be described. When the controller 302 is notified of the print data 352 via the external device 300, the controller 302 once stores the print data 352 in the memory 305. Then, the controller 302 analyzes the stored print data 352, and notifies the CPU 350 of the carry-in advance signal 353 and the storage destination signal 354 via the serial communication unit 351. The CPU 350 controls each of actuators, described below, based on the notified signal, and conveys the printed sheet S to each of the storage units 201 to 203.

Control performed at a time when the sheet S is exposed from the storage device 200 will be described below. When the user issues an instruction to discharge the sheet S stored in the storage unit, at the external device 300 or the operation unit 307, the controller 302 is notified of a discharge instruction signal 357. The controller 302 notifies the CPU 350 of the discharge instruction signal 357 via the serial communication unit 351 after determining the storage unit from which the sheet S is to be discharged, and issues an instruction to discharge the sheet S from the determined storage unit. The CPU 350 controls each of the actuators, described below, to expose the sheet S stored in the storage unit to the outside of the apparatus from the opening 250.

Each of the actuators connected to the CPU 350 will be described below.

A motor driver 358 is connected to an output terminal of the CPU 350. The motor driver 358 drives a conveyance motor 359. When the conveyance motor 359 rotates, the conveyance rollers 211, 212, and 213 rotate to convey the sheet S to each of the storage units 201 to 203.

A motor driver 360 is connected to the output terminal of the CPU 350. The motor driver 360 drives a discharge motor 361. When the discharge motor 361 is rotated in the clockwise direction (CW direction), the sheet movement unit 241 in the first storage unit 201 moves toward the opening 250. When the discharge motor 361 is rotated in a counterclockwise direction (CCW direction), the sheet movement unit 241 in the first storage unit 201 moves in a direction opposite to a direction toward the opening 250. Similarly, motor drivers 362 and 364 are connected to the output terminal of the CPU 350, to respectively drive discharge motors 363 and 365. The discharge motor 363 controls a sheet movement unit 242 in the second storage unit 202, and the discharge motor 365 controls the sheet movement unit 243 in the third storage unit 203.

The sheet presence/absence sensor 231 uses a pull-up resistor 366, to input information indicating whether the sheet S is stored in the first storage unit 201, to the CPU 350 via a buffer 367. Similarly, a sheet presence/absence sensor 232 inputs information indicating whether the sheet S is stored in the second storage unit 202 to the CPU 350, and a sheet presence/absence sensor 233 inputs information indicating whether the sheet S is stored in the third storage unit 203 to the CPU 350.

The opening sensor 236 uses a pull-up resistor 375, to input information indicating whether the sheet S is exposed to the outside of the apparatus from the opening 250, to the CPU 350 via a buffer 376.

The actuator for switching the second switching member 133 is connected to the output terminal of the CPU 350. When the actuator is turned on, the second switching member 133 is switched so that the sheet S is conveyed toward the conveyance guide 129. When the actuator is turned off, the second switching member 133 is switched so that the sheet S is conveyed toward the conveyance guide 132. Similarly, the actuator for switching the third switching member 134 is connected to the output terminal of the CPU 350. The third switching member 134 is switched so that the sheet S is conveyed toward the conveyance guide 130 when the actuator is turned on and is conveyed toward the conveyance guide 131 when the actuator is turned off.

(Description of Operation of Storage Device)

Figure 6:
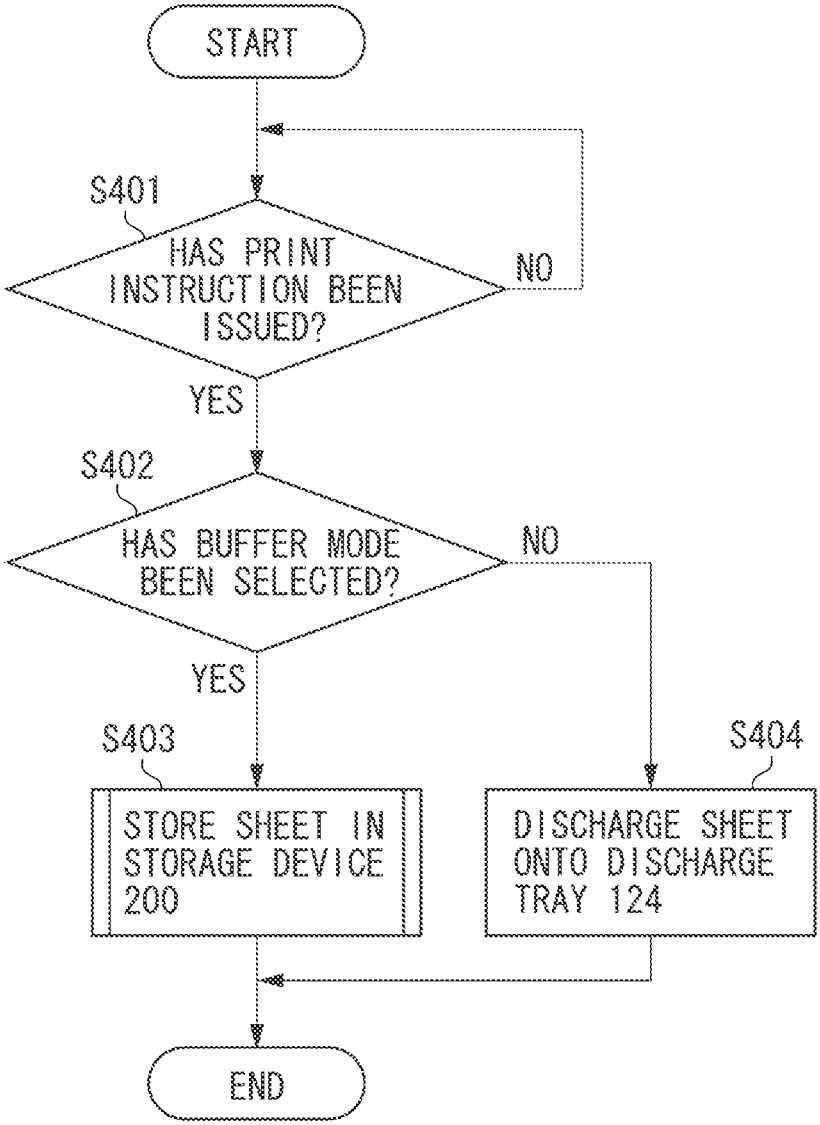
FIG. 6 is a flowchart during sheet printing in the exemplary embodiment of the present invention.

As described above, in the image forming apparatus, the user can select from the external device 300 or the operation unit 307 either one of a buffer mode in which the sheet S is once stored in the storage device 200 and a normal mode in which the sheet S is discharged onto the discharge tray 124. The selected mode is stored in the memory 305. FIG. 6 illustrates a flowchart at a time when the user issues an instruction to print the sheet S. The controller 302 described in FIG. 4 performs control based on the flowchart based on a program stored in the memory 305.

If the user first issues an instruction to print the sheet S via the external device 300, then in step S401, the controller 302 determines whether the print data 352 has been transmitted thereto. If the controller 302 receives the print data 352 (YES in step S401), then in step S402, the controller 302 refers to information stored in the memory 305, and confirms whether the buffer mode has been selected. If the buffer mode has been selected (YES in step S402), then in step S403, the controller 302 once stores the sheet S in the storage device 200. Control in step S403 will be described in detail below in FIG. 9. If the normal mode has been selected (NO in step S402), then in step S404, the controller 302 discharges the sheet S to the discharge tray 124. With that, the control based on the flowchart ends. While the flowchart illustrated in FIG. 6 presupposes a configuration in which the user previously selects the mode, the present invention is not limited to this configuration. For example, a configuration may be used in which the user determines which of the modes is used for discharging the sheet S every time the user issues an instruction to perform printing.

In the present exemplary embodiment, when the sheet S is stored in the storage device 200, the sheet S is distributed into the storage unit that differs for each job number of the sheet S. When the sheet S is exposed from the storage device 200, the sheet S of the user who has issued a discharge instruction is exposed to the outside of the apparatus from the opening 250. The user can issue the discharge instruction by inputting a password previously set to the external device 300 or the operation unit 307. Alternatively, the user can also issue the discharge instruction by causing an ID card reading unit (not illustrated) provided in the operation unit 307 to read his/her own ID card to perform user authentication. In the present exemplary embodiment, the storage units 201 to 203 respectively are provided with the separate actuators that drive the sheet movement units 241 to 243, as described above. Therefore, even if the sheets S of the same user are stored in a plurality of storage units, actuators provided therein are driven such that the user can collectively receive the sheets S. A job number of the sheet S and information about the user who has issued an instruction to print the sheet S are stored in the memory 305 provided in the controller 302. When the user issues the discharge instruction, the controller 302 specifies the sheet S to be discharged by referring to the memory 305 and instructs the storage device 200 to discharge the sheet S.

Figures 7A, 7B:
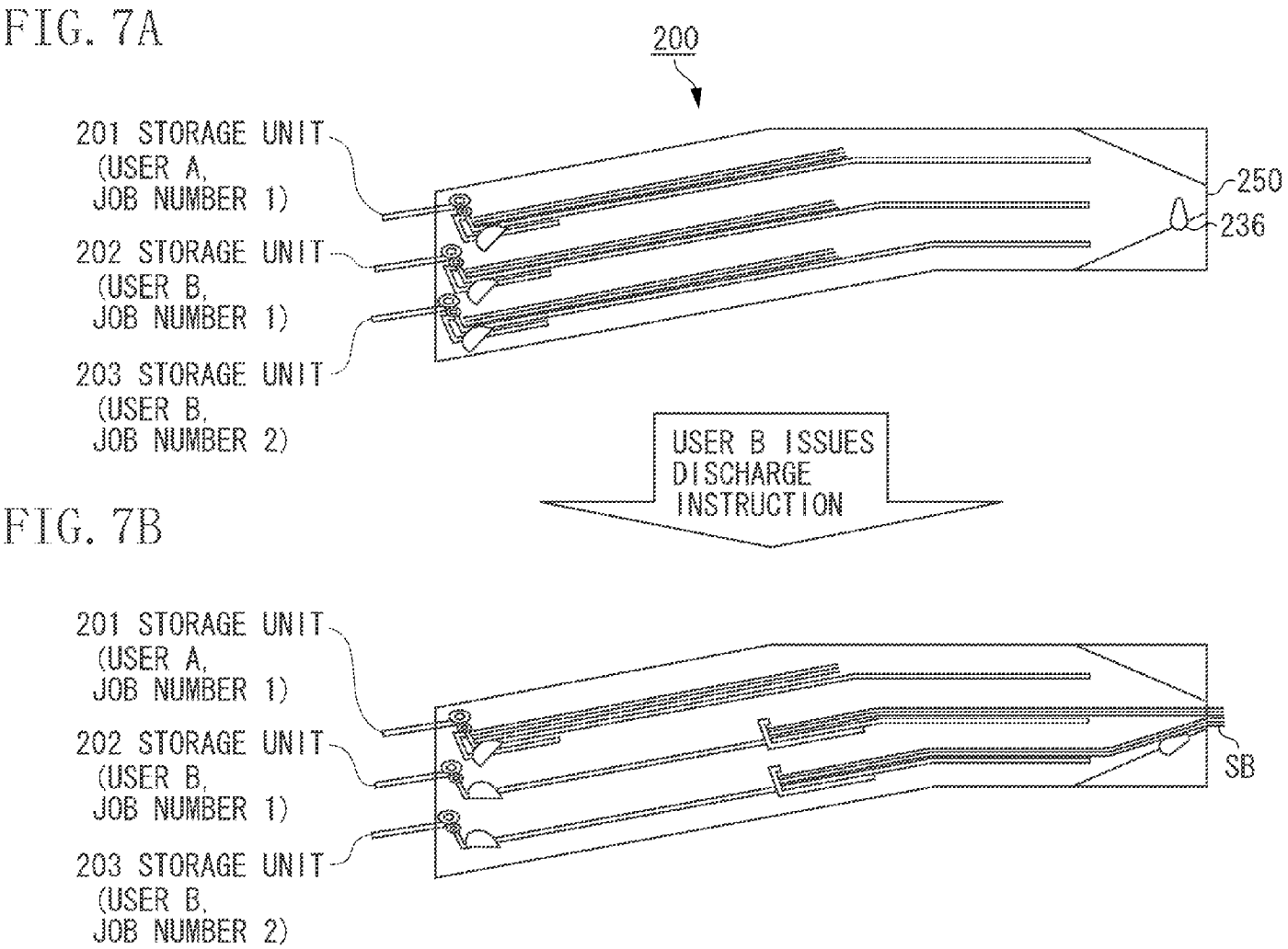
FIGS. 7A and 7B illustrate how the storage device operates during sheet exposure in the exemplary embodiment of the present invention.

FIG. 7 illustrates an example of the operation of the storage device 200. In FIG. 7A, the storage unit 201 stores sheets S of a user A, and each of the storage units 202 and 203 stores sheets S of a user B. Among the sheets S which the user B instructs the image forming apparatus 100 to print, the storage unit 202 stores the sheets S with a job number 1, and the storage unit 203 stores the sheets S with a job number 2. In FIG. 7B, when an instruction to discharge the sheets S of the user B is issued, the sheet movement units 242 and 243 in the storage units 202 and 203 move toward the opening 250, and a bundle SB of the sheets S is exposed from the opening 250.

Figure 8:
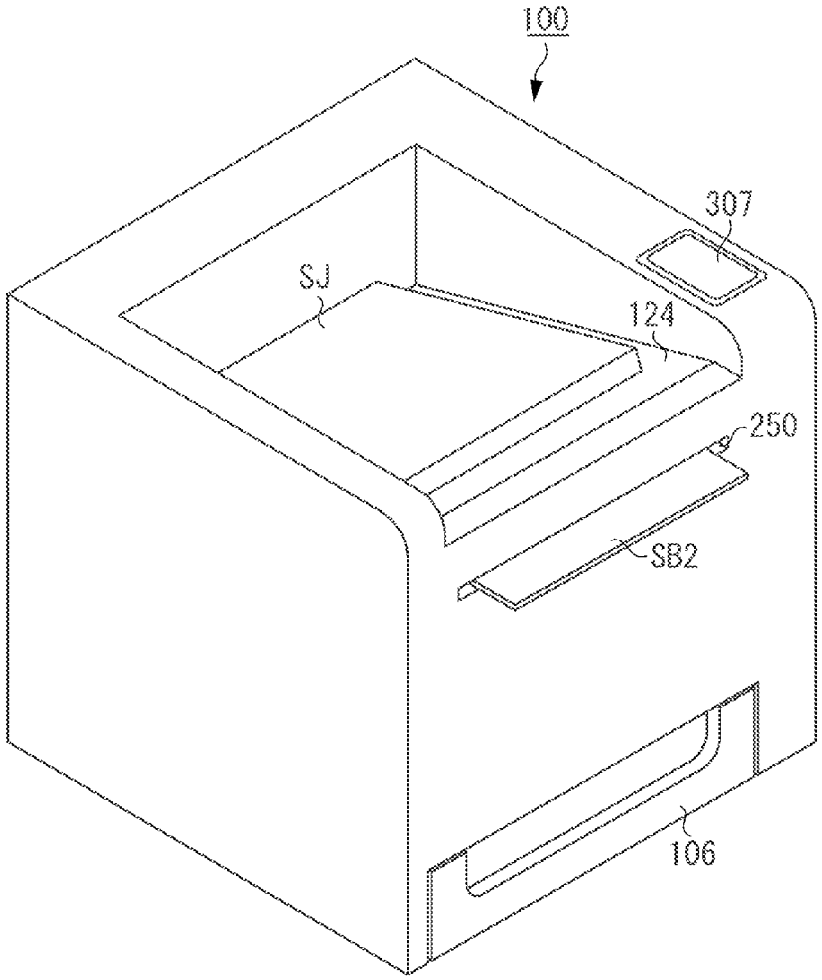
FIG. 8 is a perspective view of the image forming apparatus during sheet exposure in the exemplary embodiment of the present invention.

FIG. 8 is a perspective view of the image forming apparatus 100 at this time. A bundle SJ of sheets S printed by a plurality of users is stacked on the display tray 124. A leading edge SB2 of the sheet bundle SB discharged from each of the storage units 202 and 203 is exposed from the opening 250. The user can receive the sheet bundle SB by gasping and pulling out the leading edge SB2 exposed to the outside of the apparatus.

If the user issues an instruction to store a larger number of sheets S than the number of sheets that can be stored in the one storage unit, the sheets S are distributed into the difference storage units even if they have the same job number. The sheets S of the user B with different job numbers respectively are stored in the storage units 202 and 203 in FIG. 7A, for example. If the number of the sheets S with the job number 1 is more than the upper-limit number in the storage unit 202, however, the sheets S with the job number 1 are also distributed into the storage unit 203, on the premise that other sheets S are not stored in the storage unit 203 at this time.

The storage device 200, excluding the opening 250 for exposing the stored sheets S, is encompassed. Therefore, the user cannot see information printed on the sheets S in each of the storage units 201 to 203 with the sheets S stored in the storage unit. Thus, other users do not see the information printed on the his/her own sheets S so that confidentiality of the information can be enhanced.

On the other hand, there is an image forming apparatus that starts image formation after performing user authentication using an ID card to enhance confidentiality of information. However, compared to such an image forming apparatus, the image forming apparatus 100 according to the present exemplary embodiment may only discharge the sheets S each having the image already formed thereon from each of the storage units 201 to 203. Therefore, the user can quickly take out the sheets S without waiting until the image is formed after user authentication is performed.

Further, when the user issues a discharge instruction to the image forming apparatus 100, the user can take out only the his/her own sheets S. Thus, time and labor required for the user to search for the his/her own sheets S from the discharge tray 124 on which the sheets S and sheets of the others are mixed are saved.

(Control in Buffer Mode)

Figure 9:
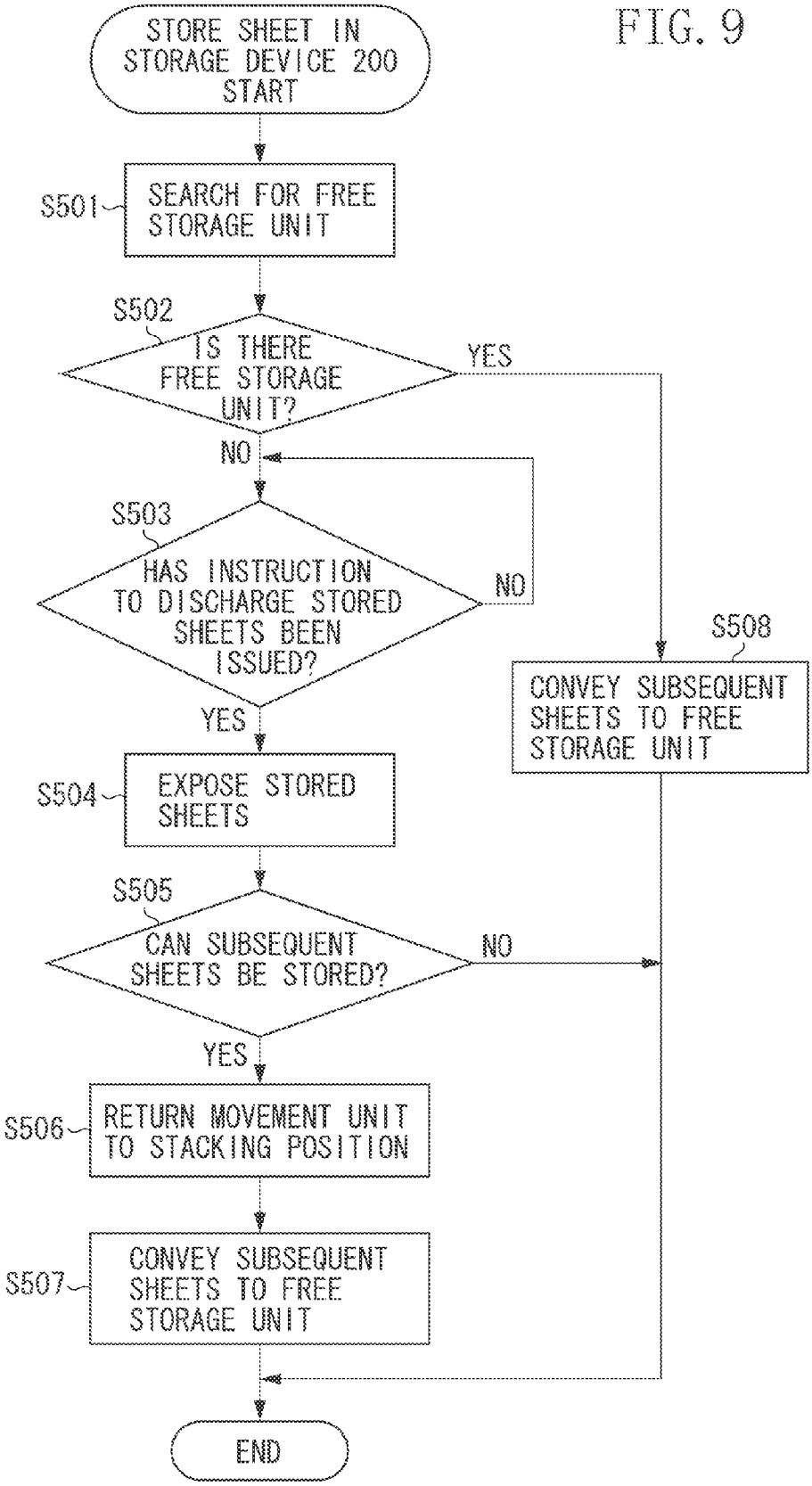
FIG. 9 is a flowchart in a first exemplary embodiment of the present invention.

Characteristic control according to the present exemplary embodiment performed at a time when the buffer mode has been selected will be described below. FIG. 9 illustrates a flowchart in the present exemplary embodiment. The flowchart illustrated in FIG. 9 is a sub process of the flowchart illustrated in FIG. 6, and corresponds to step S403. The controller 302 illustrated in FIG. 4 performs control based on the flowcharts based on the program stored in the memory 305.

When the controller 302 first shifts to the buffer mode, then in step S501, the controller 302 searches for a free storage unit. In step S502, the controller 302 determines whether there is a free storage unit. If there is a free storage unit (YES in step S502), then in step S508, the controller 302 conveys sheets S each having an image formed thereon to the free storage unit. If there is no free storage unit (NO in step S502), then in step S503, the controller 302 determines whether the user has issued an instruction to discharge the sheets S from the storage unit, at the external device 300 or the operation unit 307. If the discharge instruction has been issued (YES in step S503), the processing proceeds to step S504. In step S504, the controller 302 notifies the storage device control unit 304 of the discharge instruction signal 357 when sheets S of the user who have issued the discharge instruction are stored in the first storage unit 201, for example. The CPU 350 included in the storage device control unit 304 rotates the discharge motor 361 in the clockwise direction (CW direction) via the motor driver 360 when it receives the discharge instruction signal 357, and moves the sheet movement unit 241 to the exposure position from the stacking position. The controller 302 exposes some of the sheets S stored in the storage unit 201 to the outside of the apparatus from the opening 250. In step S505, the controller 302 determines whether subsequent sheets can be stored in the storage unit 201. The controller 302 calculates a size L4 of the sheet that can be stored in the stack tray 221 using a calculation equation of $L4=(L3+\alpha)-(L1-L2)$, where L1 is a size in a conveyance direction of the exposed sheet, L2 is a length exposed from the opening 250, of the sheet, L3 is a size in a conveyance direction of the stack tray 221, and $\alpha$ is a length from a tip end of the stack tray 221 to the opening 250. If a size in a conveyance direction of the subsequent sheets is not more than the size L4 of the sheets that can be stored in the stack tray 221, the controller 302 determines that the subsequent sheets can be stored. If the subsequent sheets can be stored (YES in step S505), then in step S506, the CPU 350 rotates the discharge motor 361 in the counterclockwise direction (CCW direction) via the motor driver 360 even if the opening sensor 236 remains turned on, and returns the sheet movement unit 241 to the stacking position. If the sheet movement unit 241 returns to the stacking position, then in step S507, the controller 302 starts to form an image on the subsequent sheets, and conveys the sheets to the storage unit 201.

Figures 10A, 10B:
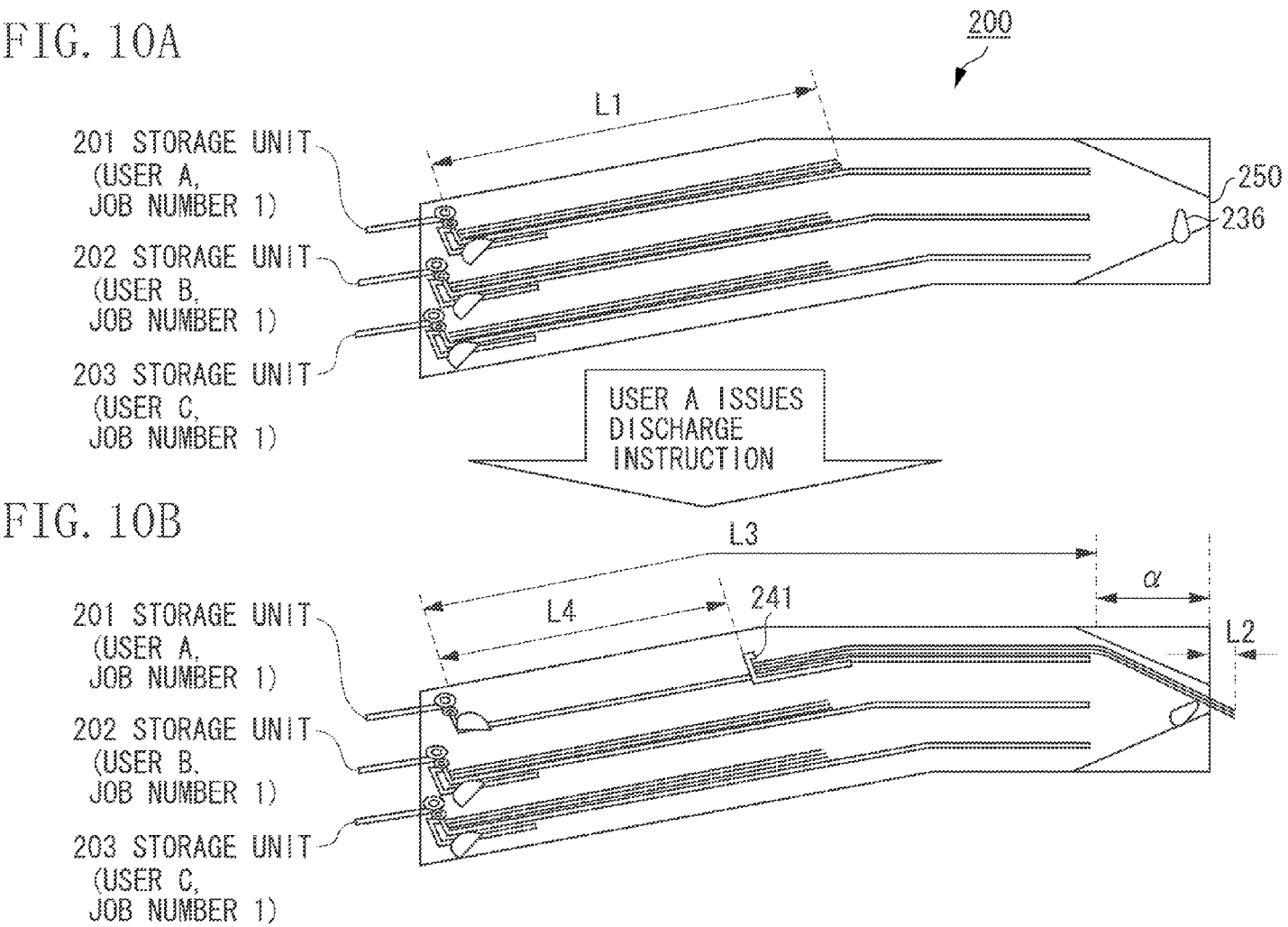
FIGS. 10A, 10B, and 10C illustrate specific examples in the first exemplary embodiment of the present invention.
Figure 10C:
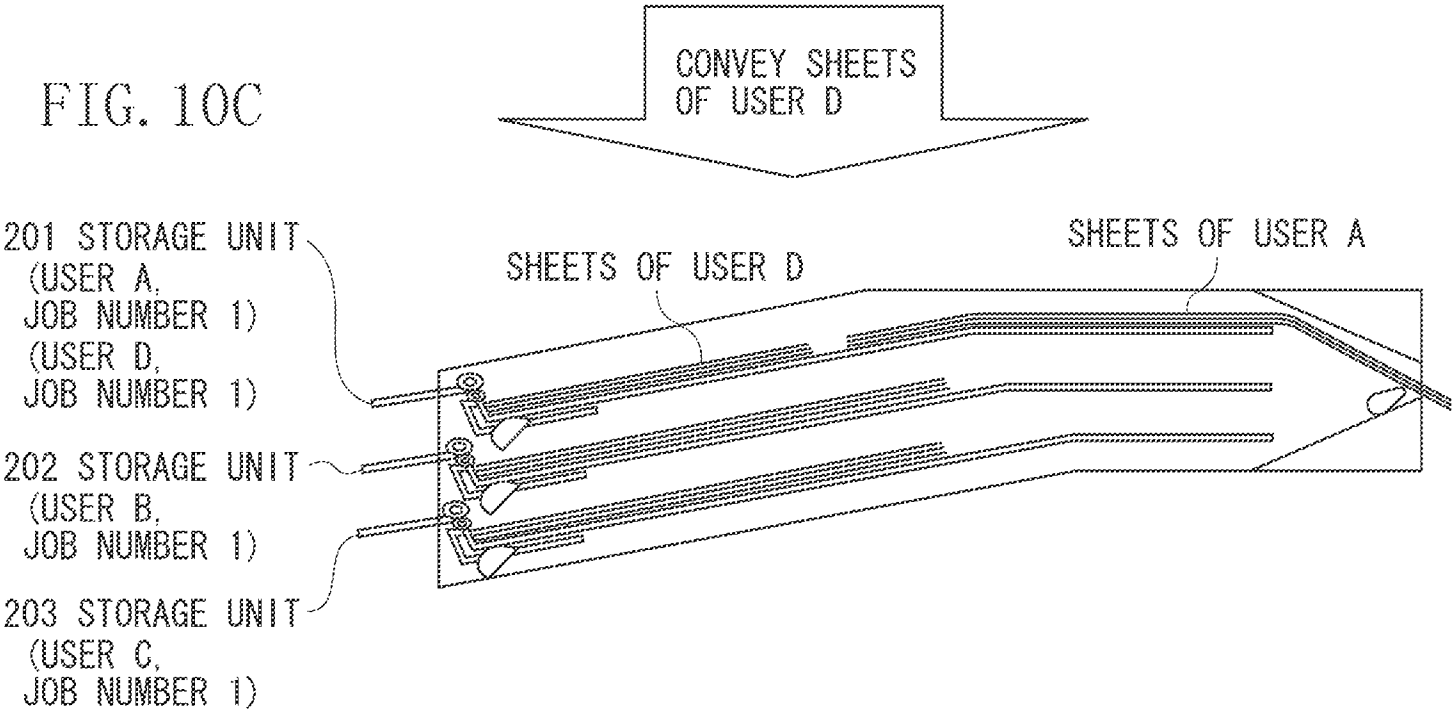

FIG. 10 illustrates a specific example of the present exemplary embodiment. In FIG. 10A, the storage unit 201, the storage unit 202, and the storage unit 203 respectively store sheets of a user A, sheets of a user B, and sheets of a user C. In this state, suppose a user D issues a printing instruction to the image forming apparatus 100 in the buffer mode. The storage device 200 has no more space that stores printed sheet separately from other sheets, and thus cannot store sheets of the user D. In FIG. 10B, when an instruction to discharge the sheets of the user A is issued, the sheet movement unit 241 in the storage unit 201 moves toward the opening 250, to expose the sheets of the user A from the opening 250. If a size in a conveyance direction of the sheets of the user D is smaller than that of a free space (L4 in FIG. 10B) at this time, the sheets of the user D can be stored in the storage unit 201. FIG. 10C illustrates a state where the sheet movement unit 241 has been returned to the stacking position, and the sheets of the user D have actually been conveyed to the storage unit 201.

A plurality of sheets can be distinguished and stored in the one storage unit by returning the sheet movement unit 241 to the stacking position before the user issues the discharge instruction to take out the sheets exposed from the opening 250 or before the opening sensor 236 is turned on from off.

Figure 11:
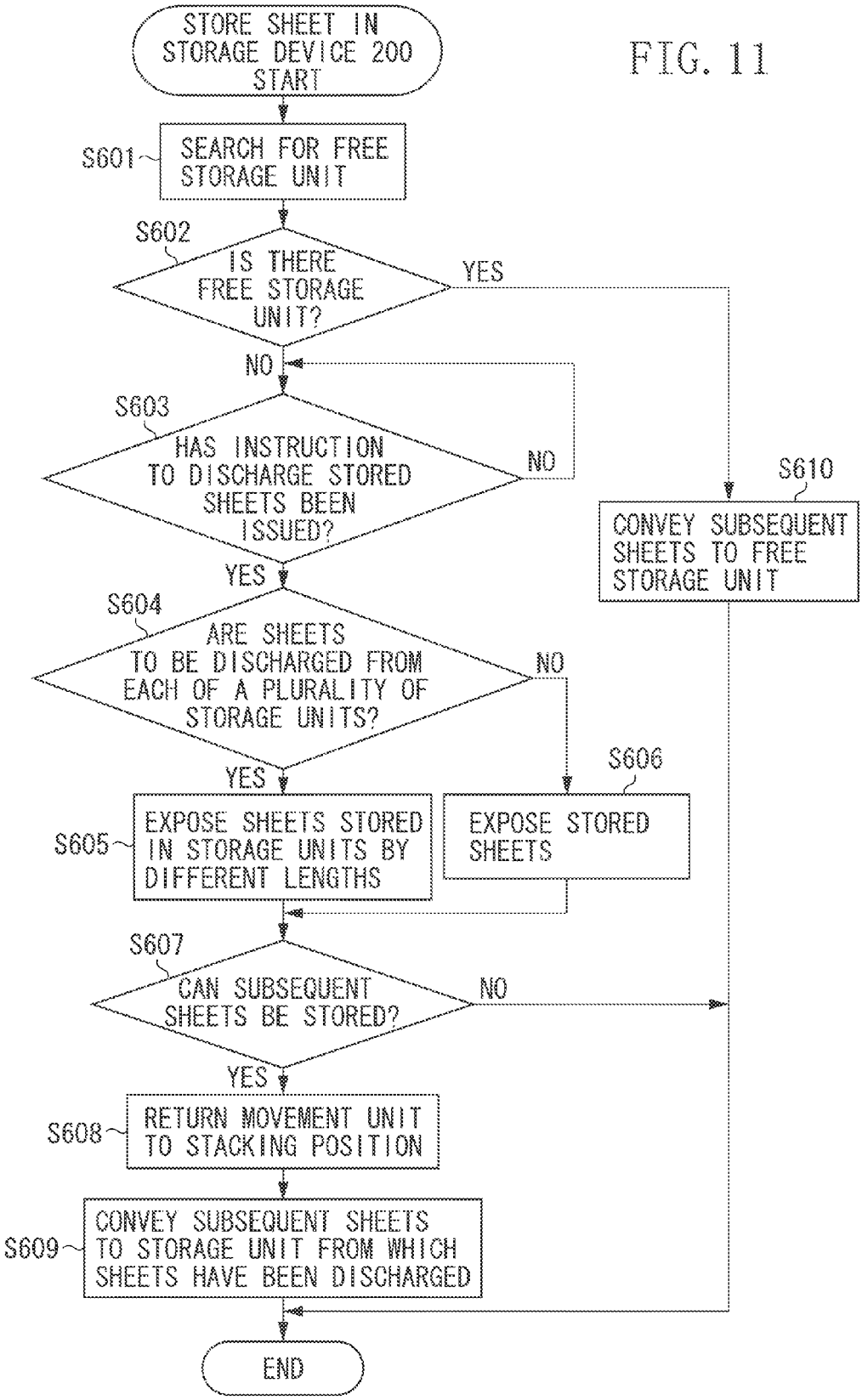
FIG. 11 is a flowchart in a second exemplary embodiment of the present invention.

In the above-mentioned first exemplary embodiment, control has been described which is performed at a time when the sheets are exposed from the one storage unit while the storage device 200 is fully-stacked. In a second exemplary embodiment, control performed at a time when sheets are exposed from a plurality of storage units will be described. Description of a principal part of the second exemplary embodiment is similar to that in the first exemplary embodiment, and only a different part of the second exemplary embodiment from the first exemplary embodiment will be described below. FIG. 11 illustrates a flowchart in the present exemplary embodiment. The flowchart illustrated in FIG. 11 is a sub process of FIG. 6, and corresponds to step S403. The controller 302 illustrated in FIG. 4 performs control based on the flowcharts based on a program stored in the memory 305.

Steps S601 to S603 in the flowchart illustrated in FIG. 11 are similar to steps S501 to S503 in the flowchart illustrated in FIG. 9, and hence description thereof is not repeated. In step S604, the controller 302 determines whether the number of storage units serving as a discharge target is plural. If the number of storage units serving as a discharge target is one (NO in step S604), then in steps S606 to S609, the controller 302 performs control similar to that in the first exemplary embodiment. If the number of storage units serving as a discharge target is plural (YES in step S604), then in step S605, the controller 302 exposes sheets stored in each of the storage units to the outside of the apparatus from the opening 250 overlapping with one another. At this time, a length by which the discharge target sheets stored in the one storage unit are exposed from the opening 250 is set to a normal length (e.g., 30 mm). A length by which the sheets stored in the other discharge target storage unit are exposed from the opening 250 is set to a length larger than the normal length (e.g., 40 mm). When sheets of a user who has issued a discharge instruction are stored in the first storage unit 201 and the third storage unit 203, for example, the controller 302 notifies the storage device control unit 304 of the discharge instruction signal 357. The CPU 350 included in the storage device control unit 304 rotates the discharge motors 361 and 365 in a clockwise direction (CW direction) via the motor drivers 360 and 364 and moves the sheet movement unit 241 and 243 toward the opening 250 when it receives the discharge instruction signal 357. At this time, a period of time during which the CPU 350 rotates the discharge motor 365 is longer by $\Delta T$ than a period of time during which the CPU 350 rotates the discharge motor 361 is rotated, so that the CPU 350 moves the sheet movement unit 243 to a position closer to the opening 250 than the sheet movement unit 241. As a result, the sheets stored in the storage unit 203 are greatly exposed by $\Delta L$ from the opening 250 compared with the sheets stored in the storage unit 201. In step S607, the controller 302 then determines whether the subsequent sheets can be stored in the sheet movement unit 241 in the one storage unit from which the sheets have been exposed by a normal length, i.e., the storage unit 201. The determination in step S607 is made by the controller 302 under the same condition as that in the first exemplary embodiment. If the subsequent sheets can be stored (YES in step S607), then in step S608, the CPU 350 rotates the discharge motor 361 in a counterclockwise direction (CCW direction) via the motor driver 360 and returns the sheet movement unit 241 to a stacking position even if the opening sensor 236 remains turned on. At this time, the sheet movement unit 243 is not returned to a stacking position and is not moved from an exposure position. If the sheet movement unit 241 returns to the stacking position, then in step S609, the CPU 350 starts to form an image on the subsequent sheets and conveys the sheets to the storage unit 201.

Figures 12A, 12B:
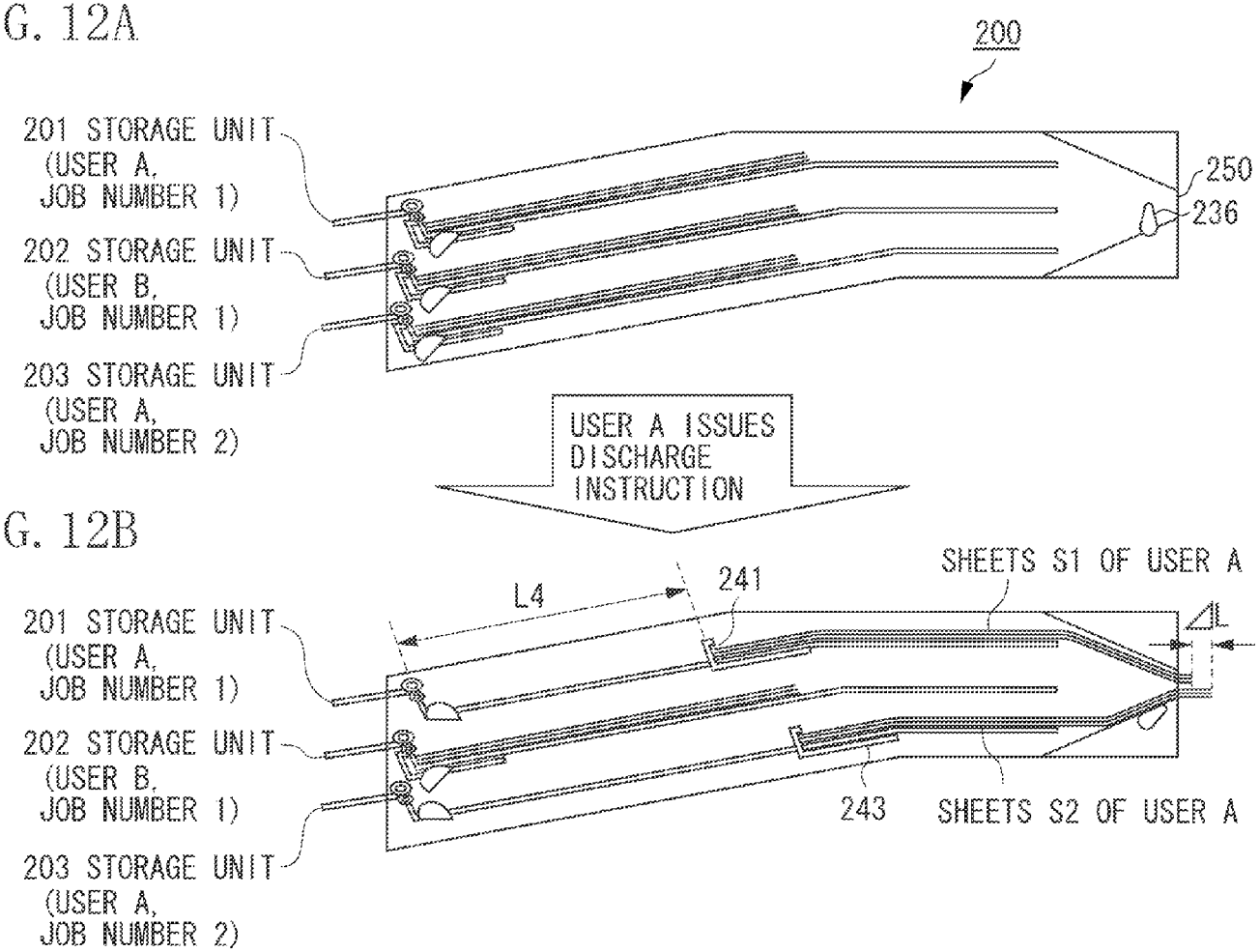
FIGS. 12A, 12B, and 12C illustrate specific examples in the second exemplary embodiment of the present invention.
Figure 12C:
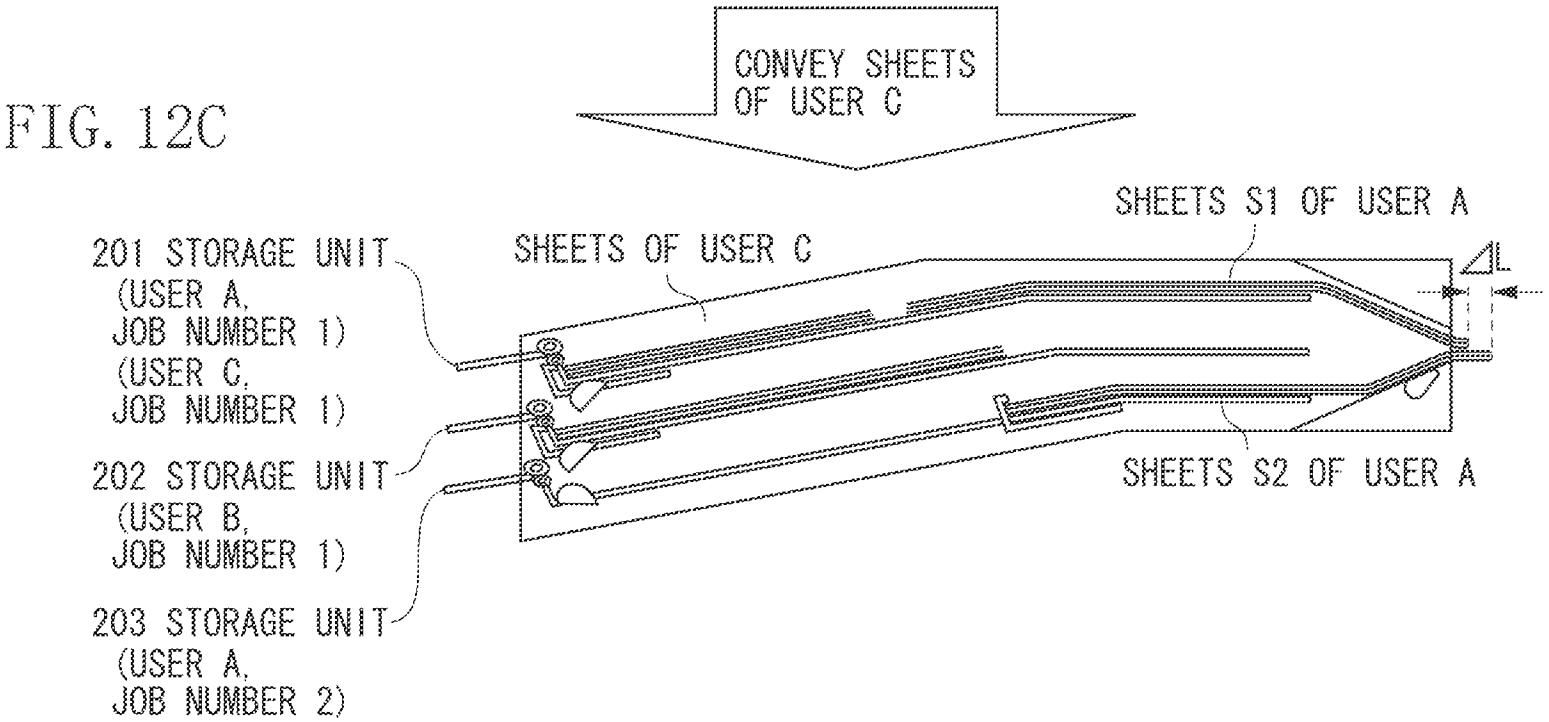

A specific example of the present exemplary embodiment is illustrated in FIG. 12. In FIG. 12A, sheets of a user A and sheets of a user B respectively are stored in the storage units 201 and 203 and the storage unit 202. Among the sheets which the user A instructs the image forming apparatus 100 to print, sheets S1 with a job number 1 and sheets S2 with a job number 2 respectively are stored in the storage units 201 and 203. In this state, suppose a user C issues a printing instruction to the image forming apparatus 100 in a buffer mode. The storage device 200 has no more space that stores printed sheets distinguished from other sheets, and thus cannot store sheets of the user C. In FIG. 12B, when an instruction to discharge the sheets S1 and S2 of user A is issued, the sheet movement units 241 and 243 move toward the opening 250, to expose the sheets S1 and S2 of the user A from the opening 250 with the sheets overlapping one another. In FIG. 12B, the sheets S2 with the job number 2 in the storage unit 203 are greatly exposed from the opening 250 by ΔL compared with the sheets S1 with the job number 1 in the storage unit 201. If a size in a conveyance direction of the sheets of the user C is smaller than that of a free space (L4 in FIG. 12B) at this time, the sheets of the user C can be stored in the storage unit 201. FIG. 12C illustrates a state where the sheet movement unit 241 has been returned to the stacking position, and the sheets of the user C have actually been conveyed to the storage unit 201. The sheet movement unit 243 has not moved from the exposure position.

The sheet movement unit 241 is located at the stacking position. Thus, if the user erroneously pushes the exposed sheets S1 into the apparatus when taking out the sheets S1, the sheet S1 may move into the storage device 200, which may prevent extraction from the opening 250. On the other hand, the sheet movement unit 243 is located at the exposure position. Thus, even if the user erroneously pushes the exposed sheets S2 into the apparatus, the sheets S2 do not move. In the present exemplary embodiment, the sheets S2 are greatly exposed from the opening 250 compared with the sheets S1 so that the user touches the sheets S2 before touching the sheets S1. Thus, the user does not easily touch the sheets S1, and can be prevented from pushing the sheets S1.

As described above, the sheets S2 stored in the storage unit 203 are greatly exposed from the opening 250 compared with the sheets S1 stored in the storage unit 201. The storage unit 201 can distinguish and store the plurality of sheets by returning the sheet movement unit 241 to the stacking position and conveying the subsequent sheets to the storage unit 201. Further, the user can be prevented from pushing the sheets, by retaining the sheet movement unit 243 at the exposure position.

In the above-mentioned second exemplary embodiment, the respective discharge target sheets stored in the plurality of storage units are all the same in size. If the respective sheets stored in the storage units are different in size, when control is performed to convey the subsequent sheets to the storage unit storing the sheets of the smallest size, the possibility that the plurality of sheets can be distinguished and stored in the one storage unit is increased.

In the above-mentioned second exemplary embodiment, the subsequent sheets are stored in the one storage unit. On the other hand, it is conceivable that the one storage unit cannot store the subsequent sheets. In the case, instead of returning only the sheet movement unit 241 to the stacking position, as in the second exemplary embodiment, the sheet movement unit 243 may also be returned to the stacking position to convey the subsequent sheets to the storage units 201 and 203.

While the length exposed from the opening 250, of the sheets is set to 30 mm in the above-mentioned exemplary embodiments, the length may be made variable depending on a size in a conveyance direction of the subsequent sheets. That is, if the size of the subsequent sheets is large, the length exposed from the opening 250, of the sheets may be increased to enlarge a space so that the subsequent sheets can be conveyed.

In the above-mentioned exemplary embodiments, the stack tray is bent, and is of a shape having the horizontal plane and the inclined plane. When an angle of the inclined plane is increased, the sheets, which have been partially exposed to the outside of the apparatus from the opening 250, may be returned into the apparatus as the sheet movement unit moves from the exposed position to the stacking position. Thus, the controller 302 may determine whether the sheets can return into the apparatus before the sheet movement unit moves from the expose position to the stacking position. For example, when one-half or more of each of the exposed sheets in the conveyance direction is put on the horizontal plane of the stack tray, the controller 302 may determine that the exposed sheets are not returned into the apparatus even if the sheet movement unit is returned to the stacking position. In the above-mentioned exemplary embodiments, the stack tray may be in a shape having only the horizontal plane.

In the above-mentioned exemplary embodiments, the sheet movement units in the storage units respectively have separate actuators. Thus, the sheets stored in the plurality of storage units can be exposed while overlapping one another by simultaneously driving the actuators. On the other hand, one actuator may selectively move the plurality of sheet movement units by providing a smaller number of actuators than the number of the storage units and providing a drive transmission switching unit such as a clutch (not illustrated). In the above-mentioned exemplary embodiments, the controller 302 is provided with the memory 305. However, the memory 305 may be provided in the engine control unit 303 or the storage device control unit 304. Alternatively, the memory 305 may be independently provided within the image forming apparatus control unit 301.

While the engine control unit 303 and the storage device control unit 304 are separately configured in the above-mentioned exemplary embodiments, the engine control unit 303 and the storage device control unit 304 may collectively be configured. In the case, the engine control unit 303 may control the conveyance unit 105 and the storage device 200.

While sheet conveyance paths are joined on the downstream side of each of the storage units and the number of openings is one in the above-mentioned exemplary embodiments, a plurality of openings may be separately provided. Sheets stored in the storage units respectively may be exposed from the separate openings.

While the three storage units are provided in the above-mentioned exemplary embodiments, the number of storage units is not limited to three. The number of storage units may be set to match an environment where the apparatus body is used, the number of users who commonly use the apparatus, or a spec for the apparatus body.

In the above-mentioned exemplary embodiments, the storage device 200 is configured integrally with the image forming apparatus 100. On the other hand, the storage device 200 may be provided being detachably attached to the image forming apparatus 100. In the case, the control unit provided in the image forming apparatus 100 may control an operation of the storage device 200. The operation of the storage device 200 may be controlled by providing a control unit independent of the storage device 200 to communicate with the control unit 301 provided in the image forming apparatus 100.

While the laser beam printer is illustrated as an example in the above-mentioned exemplary embodiments, the image forming apparatus for which the present invention is employed is not limited to this. The image forming apparatus may be a printer of another type such as an inkjet printer or a copying machine.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-225590 filed Oct. 30, 2013, which is hereby incorporated by reference herein in its entirety.

What is claimed is:

1. An image forming apparatus comprising:

a main body formed with an opening;

a storage configured to store, in the main body, a sheet having an image formed on the sheet;

a conveyer configured to convey the sheet having the image to the storage;

a mover configured to be movable to a first position where the storage is configured to store the sheet conveyed to the storage by the conveyer and a second position which is closer to the opening than the first position, wherein the sheet stored in the storage is moved when the mover moves from the first position to the second position, and is stopped in an exposed state where a part of the sheet is exposed to the outside of the main body from the opening; and a controller configured to determine whether the storage is configured to store a subsequent sheet while the moved sheet is in the storage in the exposed state, wherein, in a case where the controller determines that the storage is configured to store a subsequent sheet while the moved sheet is in the storage in the exposed state, the mover moves from the second position to the first position when the moved sheet is in the exposed state.

2. The image forming apparatus according to claim 1, further comprising a detector configured to detect the sheet in the exposed state, wherein the mover moves from the second position to the first position while the detector detects the sheet in the exposed state.

3. The image forming apparatus according to claim 1, wherein a first sheet stored in the storage is moved when the mover moves from the first position to the second position, and is stopped in the exposed state, and wherein the mover moves from the second position to the first position when the first sheet is in the exposed state, and the conveyer further is configured to convey a second sheet having an image formed on the second sheet to the storage so that a side of the first sheet resides adjacent a side of the second sheet in a conveyance direction of the first sheet.

4. The image forming apparatus according to claim 3, wherein, based on a size in the conveyance direction of the first sheet and a size in a conveyance direction of the second sheet, the controller determines whether the storage is configured to store the second sheet conveyed to the storage.

5. The image forming apparatus according to claim 4, wherein, at a time when the size in the conveyance direction of the second sheet is a first size, the second position is closer to the opening than the second position at a time when the size in the conveyance direction of the second sheet is a second size that is smaller than the first size.

6. The image forming apparatus according to claim 1, wherein the storage includes a tray on which the sheet is stacked, and wherein the tray has a horizontal plane.

7. The image forming apparatus according to claim 1, wherein the storage is a plurality of storage including a first storage and a second storage, wherein the mover is a first sheet mover configured to move a first sheet stored in the first storage to the opening and a second sheet mover configured to move a third sheet stored in the second storage to the opening, wherein a distance that the first sheet mover moves until the first sheet is in the exposed state is longer than a distance that the second sheet mover moves until the second sheet is in the exposed state, and wherein, when the first sheet stored in the first storage and the third sheet stored in the second storage are exposed from the opening overlapping with each other and stopped in the exposed state, the second sheet mover does not move and the first sheet mover moves to the first position, and the conveyer conveys a second sheet having an image formed on the second sheet to the first storage.

8. The image forming apparatus according to claim 7, wherein among the plurality of storage serving as a discharge target, a sheet of a smallest size in a conveyance direction is stored in the first storage.

9. The image forming apparatus according to claim 1, wherein the storage is a plurality of storage including a first storage and a second storage, wherein the mover is a first sheet mover configured to move a first sheet stored in the first storage to the opening and a second sheet mover configured to move a third sheet stored in the second storage and in a same print job as the first sheet, to the opening, and wherein, before an image is formed on the third sheet, the first sheet mover moves the first sheet stored in the first storage to the opening.

10. The image forming apparatus according to claim 1, wherein, before an image is formed on a subsequent sheet, the controller determines whether the storage is configured to store the subsequent sheet while the moved sheet is in the exposed state.

11. The image forming apparatus according to claim 1, wherein the storage is a plurality of storage including a first storage and a second storage, wherein the mover is a first sheet mover configured to move a first sheet stored in the first storage to the opening and a second sheet mover configured to move a third sheet stored in the second storage to the opening, and wherein the first sheet mover and the second sheet mover are configured to move one of the first sheet and the third sheet to the opening so that a user is prevented from pushing the other of the first sheet and the third sheet back into the image forming apparatus.

12. The image forming apparatus according to claim 4, wherein, in response to the controller determining that the storage is not configured to store the second sheet conveyed to the storage if the mover moves from the first position to the second position, the mover moves from the first position to a third position that moves the first sheet to a location that is further outside the opening then a location at which the first sheet would be outside the opening if the mover moved from the first position to the second position.

13. The image forming apparatus according to claim 1, wherein the storage includes a tray on which the sheet is stacked, wherein the tray has an inclined plane, and wherein the controller is configured to determine, before the mover moves from the second position to the first position, whether the sheet in the exposed state will return into the image forming apparatus if the mover moves from the second position to the first position.

14. A method for an image forming apparatus having a main body formed with an opening, a storage, a conveyer, a mover configured to be movable to a first position where the storage is configured to store the sheet conveyed to the storage by the conveyer and a second position which is closer to the opening than the first position, wherein the sheet stored in the storage is moved when the mover moves from the first position to the second position, and is stopped in an exposed state where a part of the sheet is exposed to the outside of the main body from the opening, and a controller, the method comprising:

storing, in the storage in the main body, a sheet having an image formed on the sheet;

conveying, via the conveyer, the sheet having the image to the storage;

moving the mover; and determining, via the controller, whether the storage is configured to store a subsequent sheet while the moved sheet is in the storage in the exposed state, wherein, in a case where the controller determines that the storage is configured to store a subsequent sheet while the moved sheet is in the storage in the exposed state, moving the mover includes moving the mover from the second position to the first position when the moved sheet is in the exposed state.

15. The method according to claim 14, further comprising detecting, via a detector, the sheet in the exposed state, wherein moving the mover includes moving the mover from the second position to the first position while the detector detects the sheet in the exposed state.

16. The method according to claim 14, wherein a first sheet stored in the storage is moved when the mover moves from the first position to the second position, and is stopped in the exposed state, and wherein moving the mover includes moving the mover from the second position to the first position when the first sheet is in the exposed state, and conveying, via the conveyer, a second sheet having an image formed on the second sheet to the storage so that a side of the first sheet resides adjacent a side of the second sheet in a conveyance direction of the first sheet.

17. The method according to claim 16, wherein, based on a size in the conveyance direction of the first sheet and a size in a conveyance direction of the second sheet, the controller determines whether the storage is configured to store the second sheet conveyed to the storage.

18. A non-transitory computer readable memory storing a program to cause an image forming apparatus to perform a method, wherein the image forming apparatus includes a main body formed with an opening, a storage, a conveyer, a mover configured to be movable to a first position where the storage is configured to store the sheet conveyed to the storage by the conveyer and a second position which is closer to the opening than the first position, wherein the sheet stored in the storage is moved when the mover moves from the first position to the second position, and is stopped in an exposed state where a part of the sheet is exposed to the outside of the main body from the opening, and a controller, the method comprising:

storing, in the storage in the main body, a sheet having an image formed on the sheet;

conveying, via the conveyer, the sheet having the image to the storage;

moving the mover; and determining, via the controller, whether the storage is configured to store a subsequent sheet while the moved sheet is in the storage in the exposed state, wherein, in a case where the controller determines that the storage is configured to store a subsequent sheet while the moved sheet is in the storage in the exposed state, moving the mover includes moving the mover from the second position to the first position when the moved sheet is in the exposed state.

19. The non-transitory computer readable memory according to claim 18, the method further comprising detecting, via a detector, the sheet in the exposed state, wherein moving the mover includes moving the mover from the second position to the first position while the detector detects the sheet in the exposed state.

20. The non-transitory computer readable memory according to claim 18, wherein a first sheet stored in the storage is moved when the mover moves from the first position to the second position, and is stopped in the exposed state, wherein moving the mover includes moving the mover from the second position to the first position when the first sheet is in the exposed state, and conveying, via the conveyer, a second sheet having an image formed on the second sheet to the storage so that a side of the first sheet resides adjacent a side of the second sheet in a conveyance direction of the first sheet, and wherein, based on a size in the conveyance direction of the first sheet and a size in a conveyance direction of the second sheet, the controller determines whether the storage is configured to store the second sheet conveyed to the storage.

* * * * *